US008567836B2

(12) United States Patent
LaValley et al.

(10) Patent No.: US 8,567,836 B2
(45) Date of Patent: Oct. 29, 2013

(54) GRIPPING ASSEMBLY AND GRIPPING MEMBERS FOR A GRAPPLE ATTACHMENT

(75) Inventors: Jason LaValley, Bemidji, MN (US); Roger LaValley, Bemidji, MN (US); Marvin Larson, Bemidji, MN (US); Lawrence D. Kilpo, Duluth, MN (US); Michael Burgess, Duluth, MN (US)

(73) Assignee: LaValley Industries, LLC, Bemidji, MN (US)

( * ) Notice: Subject to any disclaimer, the term of this patent is extended or adjusted under 35 U.S.C. 154(b) by 438 days.

(21) Appl. No.: 12/794,877

(22) Filed: Jun. 7, 2010

(65) Prior Publication Data

US 2010/0308609 A1 Dec. 9, 2010

Related U.S. Application Data

(63) Continuation-in-part of application No. 12/201,897, filed on Aug. 29, 2008, now Pat. No. 8,146,971.

(60) Provisional application No. 60/969,418, filed on Aug. 31, 2007.

(51) Int. Cl.
*B66C 1/42* (2006.01)
*E21B 19/20* (2006.01)

(52) U.S. Cl.
USPC ..... 294/198; 294/86.41; 294/81.61

(58) Field of Classification Search
USPC ..... 294/86.41, 81.61, 198, 67.5; 414/729, 414/732, 739; 144/4.1, 34.1, 34.5; 901/38, 901/39
See application file for complete search history.

(56) References Cited

U.S. PATENT DOCUMENTS

| | | | |
|---|---|---|---|
| 3,231,303 | A | 1/1966 | LeTourneau |
| 3,311,350 | A | 3/1967 | Irwin |
| 3,333,717 | A | 8/1967 | Scaperotto |

(Continued)

FOREIGN PATENT DOCUMENTS

| | | |
|---|---|---|
| CA | 2641321 | 4/2009 |
| DE | 295 02 091 U1 | 4/1995 |

(Continued)

OTHER PUBLICATIONS

Communication Relating to the Results of the Partial International Search for international patent application No. PCT/US2008/074903, dated Apr. 14, 2010, 2 pages.

(Continued)

*Primary Examiner* — Paul T Chin
(74) *Attorney, Agent, or Firm* — Hamre, Schumann, Mueller & Larson, P.C.

(57) ABSTRACT

A gripping assembly with gripping members, as part of a grapple attachment, used to grasp and manipulate elongated objects, for example pipe, is described. Due to the gripping action of the gripping members and tilt control capabilities of the grapple attachment, total positive control of the pipe is maintained, even if the gripping assembly picks up pipe off center. The gripping members are used at least in pairs and are mounted on a common main beam structure so that they are separated from each other. The gripping members are interchangeable with other gripping members to permit the grapple attachment to grasp different sized objects, thereby providing modularity to the grapple attachment. In one embodiment, the gripping members include a support member having a main beam structure opening extending laterally therethrough that is configured to receive a main beam structure of the gripping assembly.

19 Claims, 8 Drawing Sheets

(56) References Cited

U.S. PATENT DOCUMENTS

| | | | | | |
|---|---|---|---|---|---|
| 3,561,615 | A | * | 2/1971 | Forsberg et al. | 29/237 |
| 3,713,554 | A | | 1/1973 | Thompson et al. | |
| 3,719,296 | A | | 3/1973 | Larson, Jr. | |
| 3,727,653 | A | | 4/1973 | Tucek | |
| 3,817,567 | A | | 6/1974 | Lull | |
| 3,911,981 | A | * | 10/1975 | Tucek | 144/34.5 |
| 3,927,778 | A | | 12/1975 | Zrostlik | |
| 4,212,577 | A | * | 7/1980 | Swanson | 414/23 |
| 4,486,136 | A | | 12/1984 | Howard | |
| 4,697,509 | A | | 10/1987 | LaBounty | |
| 4,810,019 | A | | 3/1989 | Brucher | |
| 4,858,979 | A | | 8/1989 | Parma | |
| 4,951,990 | A | | 8/1990 | Hollan et al. | |
| D323,169 | S | * | 1/1992 | Saito | D15/32 |
| 5,209,536 | A | | 5/1993 | Rogers, Sr. et al. | |
| 5,219,265 | A | | 6/1993 | Recker | |
| 5,330,242 | A | | 7/1994 | Lucky, Sr. | |
| 5,562,386 | A | * | 10/1996 | Browning | 414/408 |
| 5,607,251 | A | | 3/1997 | Rafn | |
| 5,918,923 | A | * | 7/1999 | Killion | 294/202 |
| 5,975,604 | A | * | 11/1999 | Wolin et al. | 294/198 |
| 6,024,145 | A | | 2/2000 | Ackles | |
| 6,176,531 | B1 | | 1/2001 | Wheeler | |
| 6,220,807 | B1 | | 4/2001 | Sorokan | |
| 6,280,119 | B1 | * | 8/2001 | Ryan et al. | 405/156 |
| 6,347,464 | B1 | | 2/2002 | Klager | |
| 6,729,832 | B1 | | 5/2004 | Word, III et al. | |
| 7,066,076 | B2 | | 6/2006 | Roy et al. | |
| 7,357,163 | B2 | | 4/2008 | Wager | |
| 7,503,606 | B2 | | 3/2009 | Hall et al. | |
| 7,950,709 | B1 | | 5/2011 | Cheney et al. | |
| 7,980,612 | B2 | | 7/2011 | Hall et al. | |
| D645,062 | S | * | 9/2011 | LaValley et al. | D15/28 |
| 8,146,971 | B2 | * | 4/2012 | LaValley et al. | 294/86.41 |
| 8,328,071 | B2 | * | 12/2012 | LaValley et al. | 228/49.3 |
| 8,444,366 | B2 | | 5/2013 | Cole | |
| 2007/0110553 | A1 | | 5/2007 | Neal et al. | |
| 2007/0280812 | A1 | | 12/2007 | Morency et al. | |
| 2009/0057019 | A1 | | 3/2009 | LaValley et al. | |
| 2009/0155040 | A1 | * | 6/2009 | Martin | 414/744.8 |

FOREIGN PATENT DOCUMENTS

| | | | |
|---|---|---|---|
| DE | 295 02 091.1 | | 5/1995 |
| DE | 102 06 645 | A1 | 8/2003 |
| KR | 20-0227816 | | 6/2001 |
| WO | 00/53522 | | 9/2000 |
| WO | 00/65193 | A1 | 11/2000 |
| WO | 03/082725 | | 10/2003 |
| WO | 2007/097698 | | 8/2007 |
| WO | 2008/076067 | | 6/2008 |
| WO | 2009/029879 | | 3/2009 |

OTHER PUBLICATIONS

Drawings and Photographs of a Grapple manufactured by Weldco Beales Mfg.; in Applicants possession on or about Mar. 20, 2010; 15 pages.

Pictures of a grapple mechanism printed from http://rotobec.com/web/2610_PH_Pipe_and _Pole-Handler.html and http://rotobec.com/resources/images/products/rotations/RGP-252_main.jpg on Mar. 30, 2010, but possibly posted on the Internet as early as Sep. 2009; 2 pages.

Five photographs taken in Jan. 2010 of a grapple mechanism used by Michels Corporation.

Indexator Rototilt® print outs from www.indexatornorthamerica.com/index.php, printed on Sep. 8, 2011; 10 pages.

Prentice Grapples specification sheet; printed Sep. 8, 2011 from http://prenticecranes.com/prentice-grapples.html; 6 sheets.

Prentice 2410-2414 Knuckleboom Loaders; printed Sep. 8, 2011 from http://prenticecranes.com/prentice-2410-2414-knuckleboom-loaders.html; 6 sheets.

International Search Report for international application No. PCT/US2011/037121, dated Jan. 13, 2012 (3 pages).

Written Opinion of the International Searching Authority for international application No. PCT/US2011/037121, dated Jan. 13, 2012 (6 pages).

* cited by examiner

GRIPPING ASSEMBLY AND GRIPPING MEMBERS FOR A GRAPPLE ATTACHMENT

This application is a continuation-in-part of U.S. patent application Ser. No. 12/201,897, filed on Aug. 29, 2008, which claims the benefit of U.S. Provisional Application No. 60/969,418, filed Aug. 31, 2007, each of which is incorporated by reference herein in its entirety.

FIELD

This disclosure relates to a gripping assembly with gripping members, as part of a grapple attachment, for grasping and manipulating elongated objects, for example cylindrical elongated objects such as pipes, tubes, trees, etc. or non-cylindrical objects such as I-beams, rectangular or square tubing, etc. The grapple attachment is attachable to, for example, a trackhoe, backhoe, excavator or other piece of heavy construction equipment.

BACKGROUND

In the construction of pipelines or in directional drilling, it is necessary to load and offload large, unwieldy pipes from flatbed trucks. The weight of a pipe will vary depending on the diameter, wall thickness, and length, with some pipes weighing several hundred pounds per linear foot.

At the construction site, each pipe is individually lifted from or loaded onto the bed of a truck, rail car or pipe rack. Normally, nylon straps and cables, with or without manual calipers, are secured around the pipe than attached to the bucket of an excavator. The calipers or nylon straps are placed, as close as possible, at the longitudinal center of the pipe. This is important since being off-center, even by a few inches, results in decreased control and unwanted tilt of the pipe. In addition, it is necessary to station at least one worker at each end of the pipe to steady and guide the pipe as it is moved into location. The workers then manually tilt and rotate the pipe into position. This is cumbersome and dangerous which requires three or more workers (excavator operators and two pipe workers).

Pipe hooks are also used to manipulate the pipe. The pipe hooks are located at each end of the pipe and are attached to cables. A worker is provided at each end of the pipe to place the hooks and control the motion of the pipe. When unloading the pipe from the truck in this manner, it is dangerous for the worker as the worker can easily fall off of the truck or be hit by or crushed by the pipe.

Current pipe loaders also require that pipes be loaded/offloaded in a certain order and that spacing be provided between pipes so that the calipers are able to access the areas next to and under the pipes. Even so, it is not uncommon for pipes to be knocked free of the pipe pile, causing dangerous conditions or damaging the pipe.

Pipeline vacuum lifts are also used to lift large diameter pipes. While a vacuum lift eliminates the need for workers at each pipe end, the vacuum lift needs to be generally centered on the pipe to avoid tilting of the pipe. If the vacuum lift is not centered properly on the pipe, an off center lift occurs creating a tipping movement. This tipping movement can break the vacuum seal between the vacuum lift and the pipe or result in dangerous tilting and loss of control of the pipe. In addition, loss of suction or vacuum power can result in release of the pipe from the vacuum lift resulting in dangerous conditions. In addition, in order to obtain an effective seal of the vacuum lift, the surface of the pipe must be clean without the presence of any dirt, snow or ice.

SUMMARY

A gripping assembly with gripping members, as part of a grapple attachment, used to grasp and manipulate elongated objects, for example pipe of various diameters and lengths, is described. The gripping attachment is configured to improve loading and unloading of pipe to and from a stack of pipes, for example, on a bed of a truck, rail car or pipe rack with minimal disturbance of or damaging of adjacent pipes or the pipe coating while providing control over the positioning of the pipe, as well as permit controlled laying of pipe, while reducing manpower and eliminating the need for precise centering of the gripping assembly on the pipe. Due to the gripping action of the gripping members and tilt, rotation and shift control capabilities of the grapple attachment, total positive control of the pipe is maintained, even if the gripping assembly picks up the pipe off center. The grapple attachment is able to be used on all pipe surface types, including pipe surfaces that are dirty, or snow or ice covered. The gripping members are configured to prevent damage, not only to the pipe being manipulated, but to adjacent pipes. The gripping members are configured so that the gripping pressure will not crush the pipe.

The gripping members are used at least in pairs and are mounted on a common main beam structure so that they are separated from each other. The gripping members are interchangeable with other gripping members to permit the grapple attachment to grasp different sized objects, thereby providing modularity to the grapple attachment. In one embodiment, the configuration of the gripping member grab arms allow for the pipe to be clamped or grasped by the grab arms and not rolled into the grab arms as is typical.

In one embodiment, the gripping members are configured to be adjustable together to change their position on the main beam structure while maintaining the distance between the gripping members. In another embodiment, one or more of the gripping members are adjustable on the main beam structure in order to alter the distance between the gripping members. In another embodiment, the gripping members are fixedly attached to the main beam structure. As an alternative, the main beam structure can be configured to be adjustable in length, thereby altering the distance between the gripping members, or altering the positions of the gripping members while maintaining the distance therebetween. In addition, the main beam structure can be configured so that it moves on the longitudinal axis in relation to the swivel assembly.

In one embodiment, a gripping member useable with a gripping assembly of a grapple attachment is provided that includes a support member. The support member includes a main beam structure opening extending laterally therethrough that is configured to receive a main beam structure of the gripping assembly. A first grab arm and a second grab arm are connected to the support member. Each of the first grab arm and the second grab arm taper toward a free end, and at least one of the first and second grab arms is pivotally connected to the support member so that the first and second grab arms have a gripping position and a non-gripping position. A first actuator has one end connected to the support member and a second end connected to the one pivotally connected grab arm. The support member and the first and second grab arms define an object receiving area when the first and second grab arms are at the gripping position, where the object receiving area is disposed below the main beam structure opening.

In another embodiment, a grapple attachment includes a bracket attachment configured to attach to a piece of construction equipment, a lower head assembly connected to the bracket attachment and configured to be rotatable about a swivel axis, and a gripping assembly pivotally connected to the lower head assembly for pivoting movement about a pivot axis that is substantially perpendicular to the swivel axis. The gripping assembly includes a main beam structure that extends along a longitudinal axis that is substantially perpendicular to the swivel axis and the pivot axis. A plurality of gripping members are connected to the main beam structure, and each of the plurality of gripping members are actuatable between a non-gripping position and a gripping position. At least one of the gripping members is adjustable in position relative to the swivel axis and the pivot axis in a direction parallel to the longitudinal axis.

Each gripping assembly uses actuators, for example hydraulic actuators, to actuate the gripping motion by moving one or more grab arms, for tilting the main beam structure, and to adjust the location of the gripping members. Load hold valves are provided ensuring that the grab arms stay locked in position if a hydraulic hose fails.

In one embodiment, the gripping member comprises one stationary grab arm and one movable grab arm where the grab arms are on the same plane or vertical axis. In another embodiment, the gripping member comprises two movable grab arms where the grab arms are angled, creating six points of contact which is useful for picking up pipe, and the grab arms are not on the same vertical axis, i.e. offset. In another embodiment, the gripping member comprises two movable grab arms where the grabs arms are crescent shaped and offset.

The gripping members are preferably made primarily of metal, and include a support member formed by spaced apart plates or forged or molded from solid metal.

The gripping members described herein provide a more precise fit around the pipe. There is positive total control of the pipe and no free direction of movement due to the elimination of unwanted swing and tilt.

DRAWINGS

DETAILED DESCRIPTION

A gripping assembly with gripping members, as part of a grapple attachment, used to grasp and manipulate elongated objects, for example pipe, is described. Throughout this specification, for ease of discussion and clarity, reference and description will be made to the objects as being pipe. The described grapple attachment can be used in the pipeline construction industry to grasp and manipulate pipe of varying diameters, including large diameter pipe, for example 20 inch pipe, but can be used in other industries as well, such as the logging industry, to grasp other objects. It is to be understood that the concepts as described herein can be equally applied to the grasping and manipulating of any elongated objects, whether cylindrical or non-cylindrical, for example pipes, cylindrical tubes, trees, I-beams, square tubes, triangular tubes, etc.

The grapple attachment allows for the picking of pipe from, and placement of pipe on, a stack of pipes without disturbing or damaging adjacent pipes while providing control over the positioning of the pipe. The grapple attachment can also be used to lay pipe, for example in a trench, and to remove pipe. The grapple attachment is able to be used on all pipe surface types, including pipe surfaces that are dirty, or snow or ice covered. The gripping members are configured to prevent damage, not only to the pipe being manipulated, but to adjacent pipes and the coatings of the adjacent pipes. The gripping members are configured so that the gripping pressure will not crush the pipe.

The grapple attachment uses actuators, for example, to actuate the gripping motion by moving grab arms, for tilting the main beam structure and to alter the positions of the gripping members. The actuators described herein can be hydraulic actuators, pneumatic actuators, mechanical actuators such as screw-type actuators or geared actuators, or other actuators suitable for the purpose.

As described herein, an open or non-gripping position is one in which first and second grab arms are moved away from each other so that a pipe can fit in the space between the grab arms. A closed or gripping position is one in which the grab arms are moved towards each other so that a pipe located between the grab arms is squeezed between the grab arms to permit the pipe to be picked up. The configuration of the grab arms results in the pipe being clamped or grasped by the grab arms and not rolled into the grab arms as is typical.

Figure 1A:
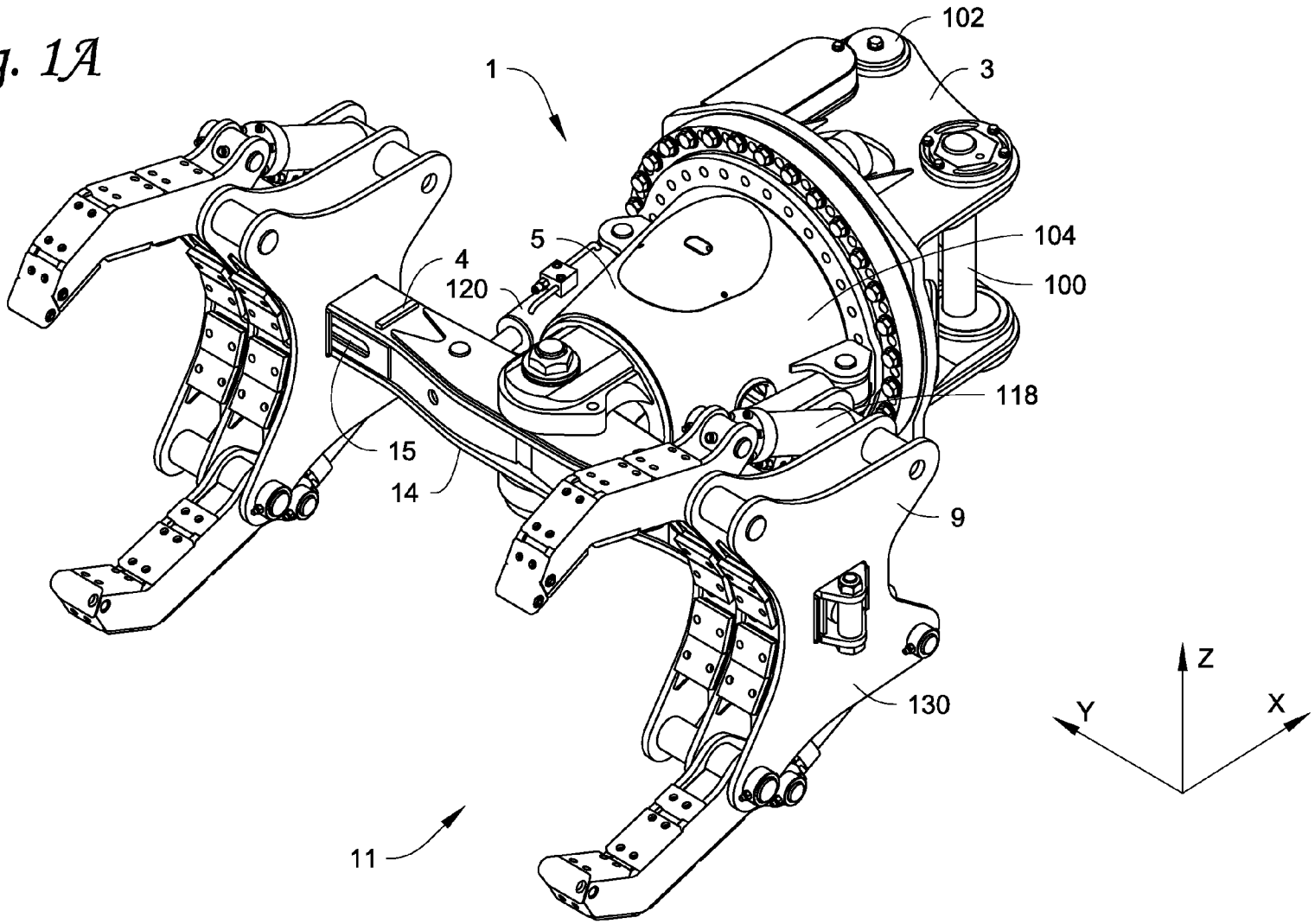
FIG. 1A illustrates a grapple attachment with a gripping assembly.
Figure 1B:
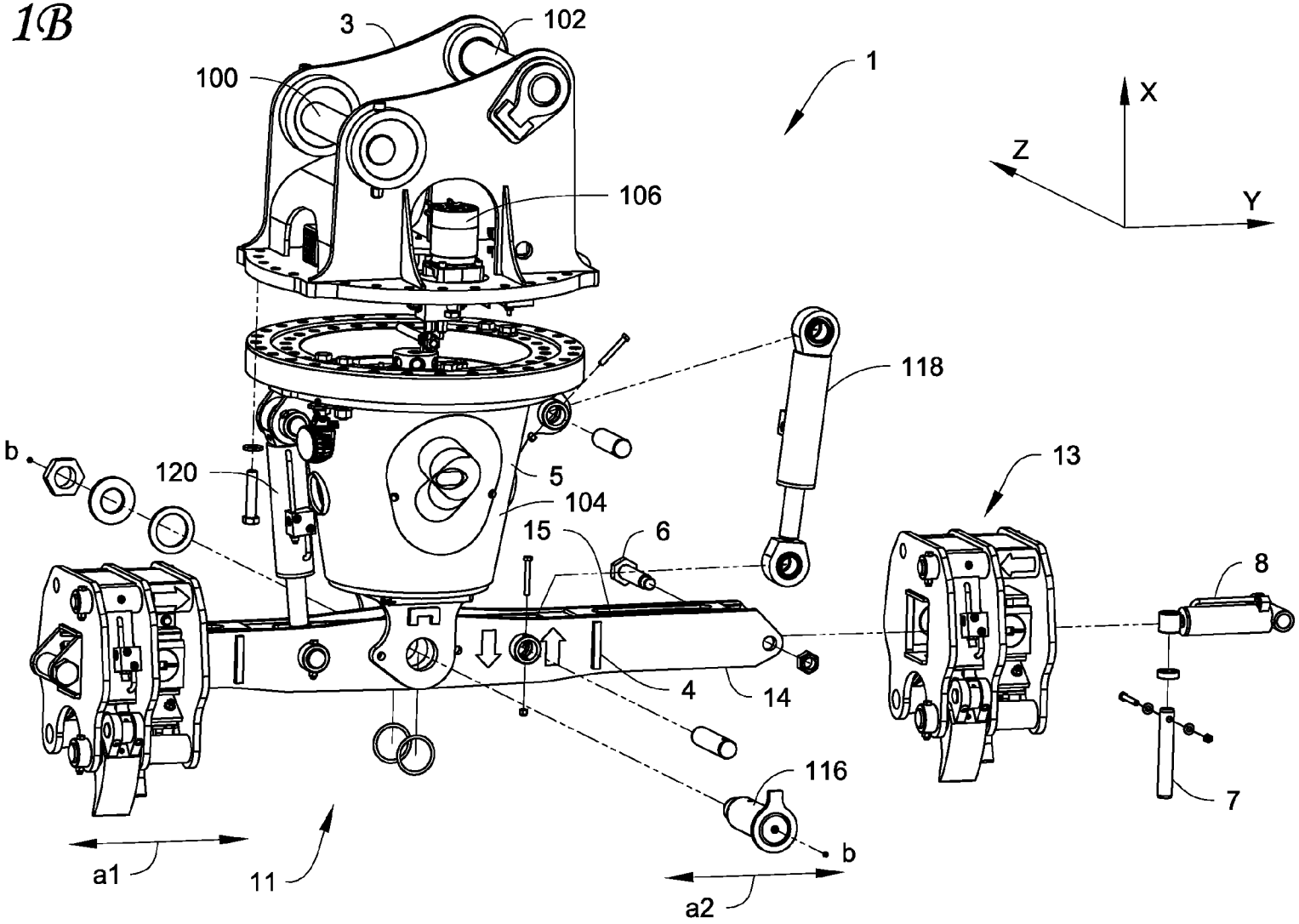
FIG. 1B is an exploded view of a grapple attachment similar to FIG. 1A but with a set of gripping members illustrated in FIG. 6.
Figure 2:
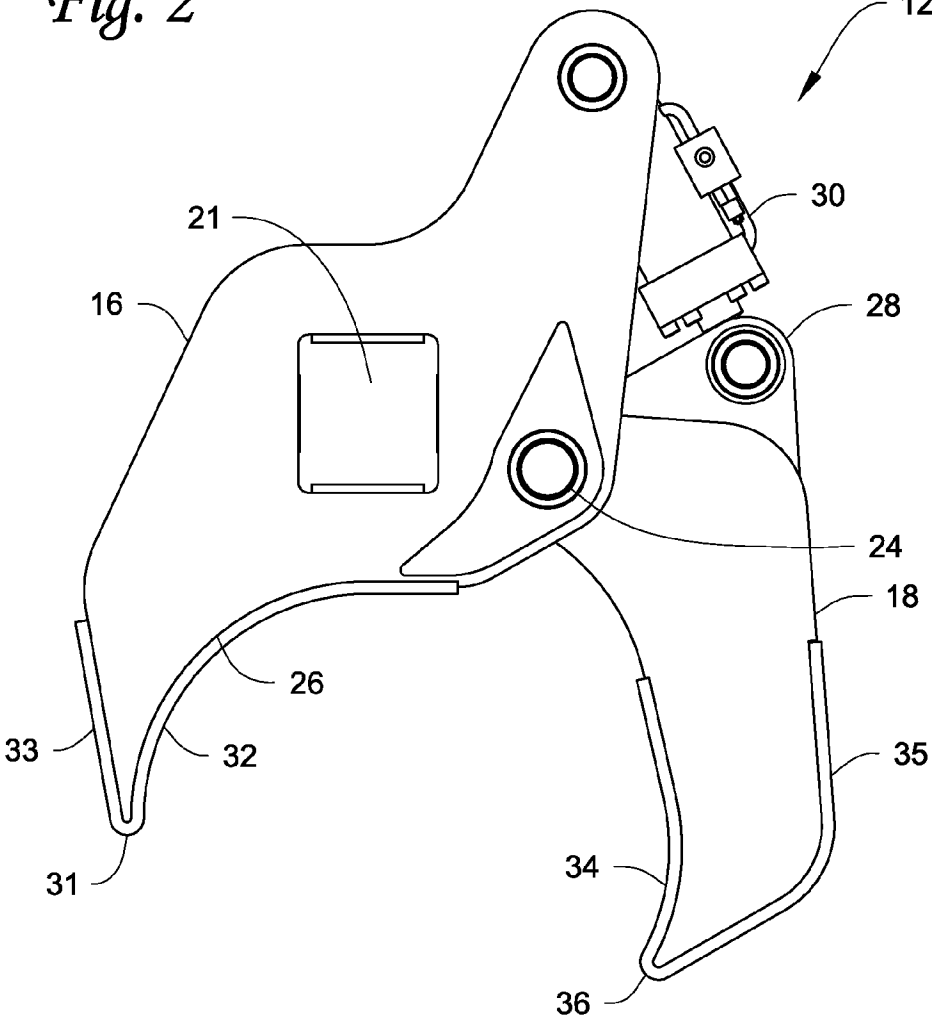
FIG. 2 is a front view of another embodiment of a gripping member having one stationary grab arm and one movable grab arm.

FIGS. 1A and 1B illustrate examples of a grapple attachment 1 provided with a gripping assembly 11 having different embodiments of gripping members 9, 13. Another embodiment of a gripping member 12 is illustrated in FIG. 2. The gripping members 9, 12, 13 are designed to be interchangeably mountable on the gripping assembly 11 to allow alteration of the type of gripping member 9, 12, 13 used on the grapple attachment 1.

The grapple attachment 1 comprises a bracket attachment 3, a swing drive 106, a lower head assembly 5, tilt actuators 118, 120 and the gripping assembly 11. The bracket attachment 3 is configured to attach to a piece of construction equipment, for example an excavator, trackhoe, backhoe, etc. In the illustrated embodiment, the bracket attachment 3 attaches to the construction equipment via a pair of spaced attachment pins 100, 102.

Figure 10:
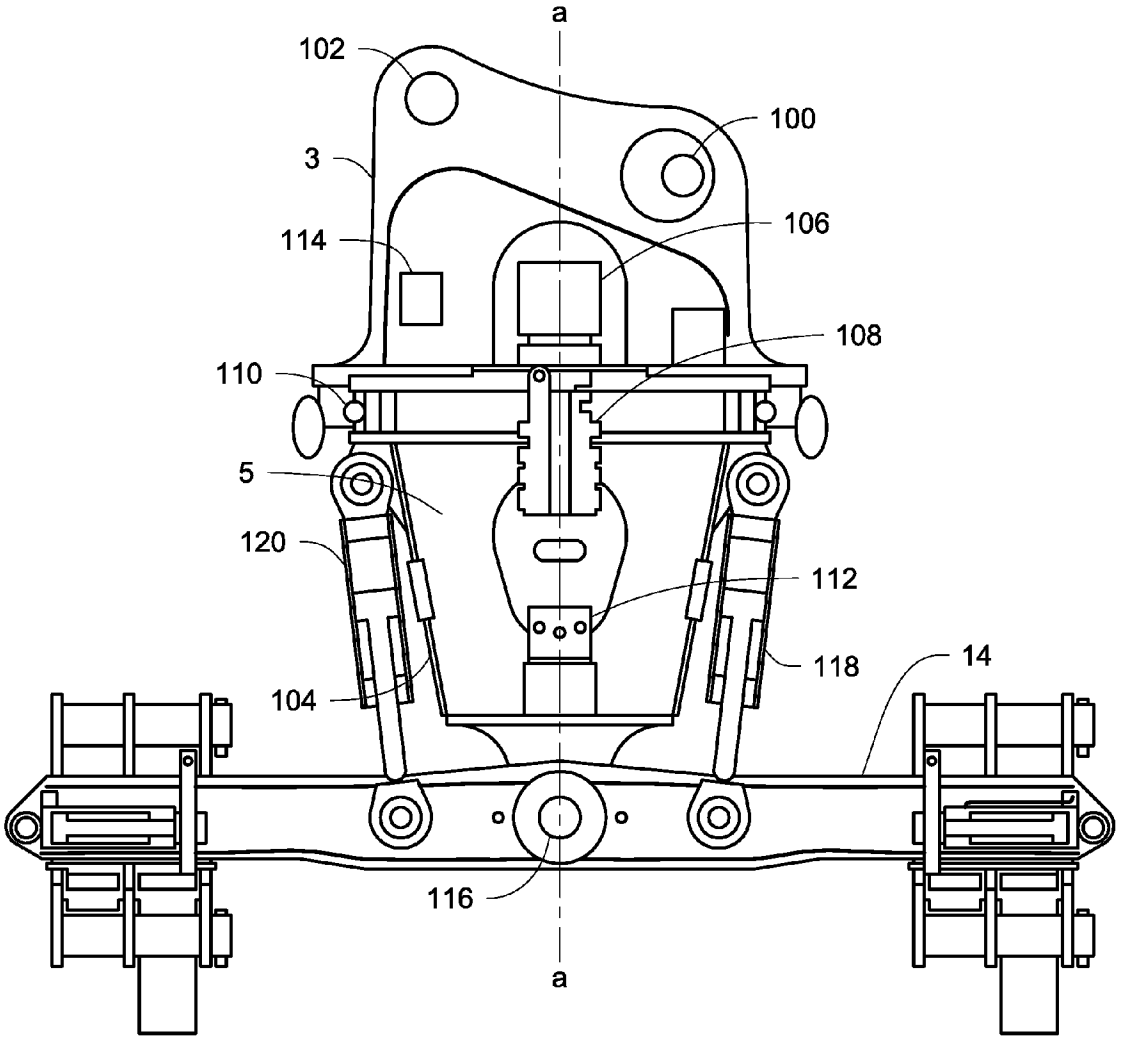
FIG. 10 is a cross-sectional view of the grapple attachment.

The swing drive 106 rotates the lower head assembly 5 about a swivel axis a-a (shown in FIG. 10) that extends along the x-axis or vertical axis through a centre point of the lower head assembly 5. With reference to FIG. 10, the rotation control includes a hydraulic swing motor 106 that causes rotation of the lower head assembly 5 about the axis a-a driven by the motor 106. A hydraulic swivel 108 transfers hydraulic pressure between the stationary/rotating boundary between the bracket attachment 3 and the lower head assembly 5 for use by various hydraulic components of the grapple attachment 1. A swing bearing 110 between the bracket attachment 3 and the lower head assembly 5 permits rotation relative to the bracket attachment 3. A hydraulic manifold 112 is located in the housing 104 for directing hydraulic fluid to various hydraulic actuators. A main hydraulic control valve 114 is mounted on the bracket attachment 3.

With continued reference to FIGS. 1A, 1B and 10, the gripping assembly 11 is pivotally connected to the lower head assembly 5 by a pivot pin 116 so that the gripping assembly 11 can pivot about a pivot axis b-b disposed on a z-axis or lateral axis that is substantially perpendicular to the swivel axis a-a.

The gripping assembly 11 comprises a longitudinal support structure or main beam structure 14 that supports various embodiments of the gripping members 9, 12, 13. The main beam structure 14 extends along a longitudinal axis (y-axis) that is substantially perpendicular to the swivel axis a-a and the pivot axis b-b. The main beam structure 14 can have any configuration suitable for supporting the gripping members 9, 12, 13 and performing the other functions of the main beam structure 14 implied by this description. In the illustrated embodiment, the main beam structure 14 is a generally rectangular, tubular beam that has a generally square cross-section. The main beam structure 14 can alternatively be, for example, cylindrical or triangular, or be shaped like an I- or H-beam, and can also be a solid structure.

Tilt actuators 118, 120 are provided for positively controlling pivoting movement of the main beam structure 14 about the pivot axis b-b, thereby controlling the angle of tilt of the gripping assembly 11 and a pipe held thereby. The tilt actuators 118, 120 are identical in construction although they could be different if desired. In the illustrated embodiment, the tilt actuators 118, 120 are hydraulic actuators, although other types of actuators could be used, for example pneumatic actuators or mechanical actuators. The tilt actuators 118, 120 have a first end connected to the housing 104 of the lower head assembly 5 and a second end connected to the main beam structure 14.

As shown by the arrows in FIG. 1B, at least one of the gripping members 13 (as well as the gripping members 9, 12), or both of the gripping members 13, are designed to be adjustable in position relative to the swivel axis a-a and the pivot axis b-b in a direction parallel to the longitudinal axis y.

For example, the gripping members 9, 12, 13 can be slidably disposed on the main beam structure 14. For each of the gripping members 9, 12, 13, the means for slidably disposing the gripping members 9, 12, 13 on the main beam structure 14 and for adjusting the positions of the gripping members 9, 12, 13 on the main beam structure 14 are the same and will be described in the following paragraph with respect to the gripping members 13.

The gripping members 13 are longitudinally adjustable on the main beam structure 14 by sliding back and forth on the main beam structure 14 in the directions shown by the arrows a1, a2. The gripping members 13 are disposed at opposite ends of the main beam structure 14. For each gripping member 13, a shift actuator 8 is mounted within the main beam structure 14 along the longitudinal direction thereof. The gripping members 13 are connected to one end of the shift actuator 8 via, for example, a fastening pin 7. The other end of the longitudinal actuator 8 is fixed to the main beam structure 14 via a fastening means 6, for example, a bolt. The shift actuators 8 are illustrated as hydraulic actuators although other types of actuators can be used, such as pneumatic or mechanical actuators.

Actuation of the shift actuator 8 moves the attached gripping member 13 via the fastening pin 7 along the main beam structure 14 on the longitudinal axis. Actuation of the shift actuator 8 results in the shortening or lengthening of the shift actuator 8. As the fastening pin 7 is connected to one end of the shift actuator 8, the fastening pin 7 thus moves in relation to the shift actuator 8. And, as the gripping member 13 is connected to the fastening pin 7, the gripping member 13 thus moves in relation to the fastening pin 7 and the shift actuator 8. The fastening pin 7 is held within and travels in a longitudinal slot 15 in the main beam structure 14 thereby controlling the pathway of the fastening pin 7. Stops 4 are provided on the main beam structure 14 to limit the range of movement of the gripping members 13 and prevent the gripping members 13 from over travel.

In one embodiment, the gripping members 13 and the shift actuators 8 can be configured to move the gripping members 13 in a number of ways. For example, the gripping members 13 can move simultaneously in the same direction such that the distance between the gripping members 13 remains the same. Alternatively, the gripping members 13 can be made to move independently of each other, or move simultaneously with each other, to allow adjustment in the distance between the gripping members 13.

Instead of moving the gripping members 13, it is contemplated herein that the main beam structure 14 can be configured to be alterable in length while the gripping members 13 remain relatively fixed on the main beam structure 14, so as to shift the positions of the gripping members 13, either with the same distance therebetween or altering the distance between the gripping members 13. Alternatively, the main beam structure 14 could be configured so that it is adjustable along the longitudinal axis in relation to the lower head assembly 5.

Figure 4:
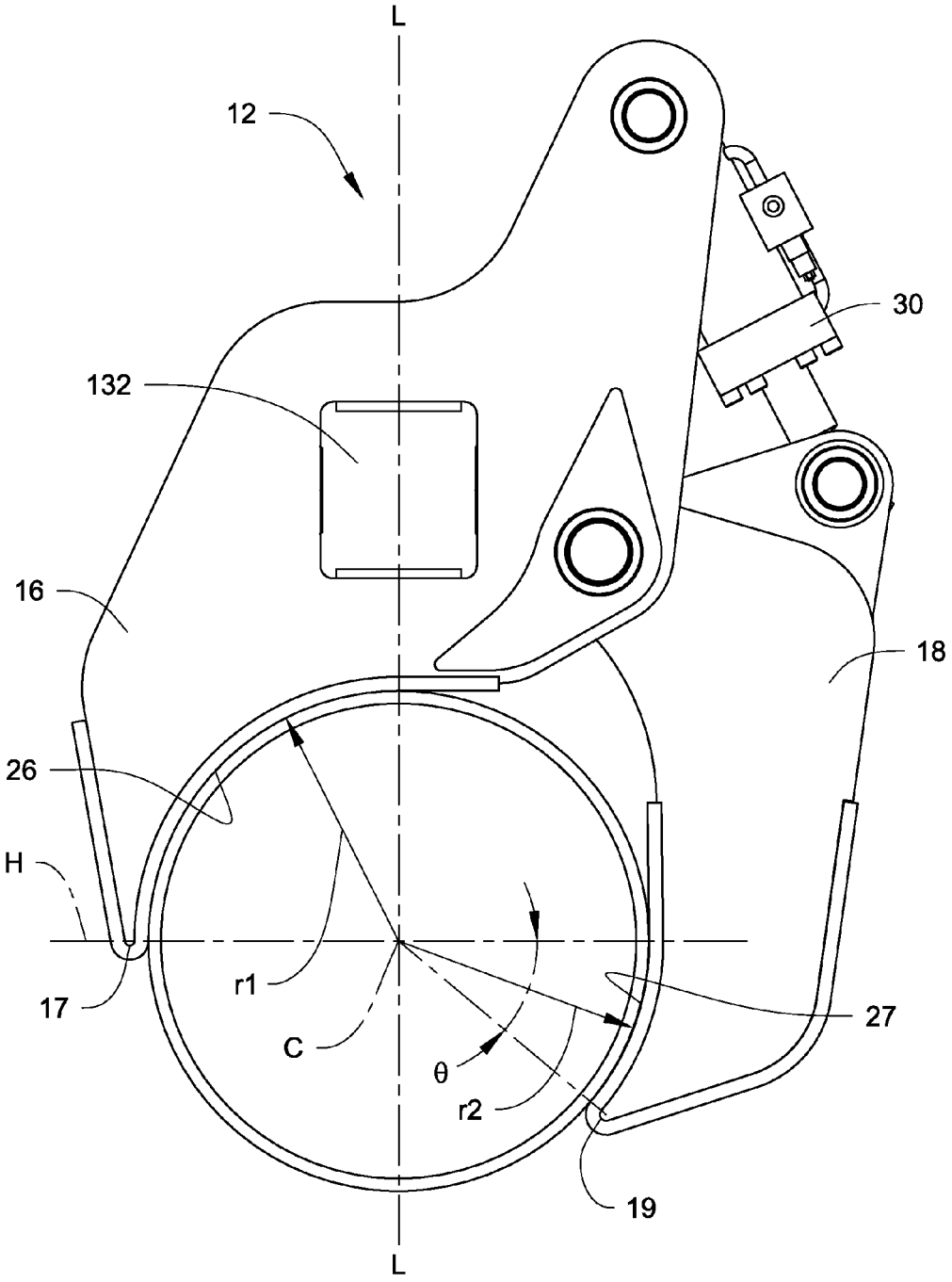
FIG. 4 is a diagrammatic front view of the gripping member of FIG. 2 while gripping a pipe.

As indicated above, the gripping members 13 are mounted so as to be replaceable by differently configured gripping members 9, 12, 13 designed to perform the broad function of gripping an object, but in different ways or for different sized objects. Each of the gripping members 9, 12, 13 includes a support member 130 that includes a main beam structure opening 132 (as shown in FIG. 4) extending laterally therethrough that is configured to allow passage of the main beam structure 14 when the gripping member 9, 12, 13 is mounted on the main beam structure 14. The support member 130 can take on a number of different configurations as long as the support member 130 can support one or more grab arms as discussed further below, and the support member 130 can be suitably mounted on the main beam structure 14. In the embodiments illustrated and described herein, the support members 14 are made from spaced apart metal plates. However, the support members 14 could be forged or molded from solid metal. As illustrated and described herein, the gripping members 9, 12, 13 are mounted on the main beam structure 14 so that they are movable and can be longitudinally adjusted. However, the gripping members 9, 12, 13 can be fixedly attached to the main beam structure 14 so that they have no longitudinal movement.

Figure 3:
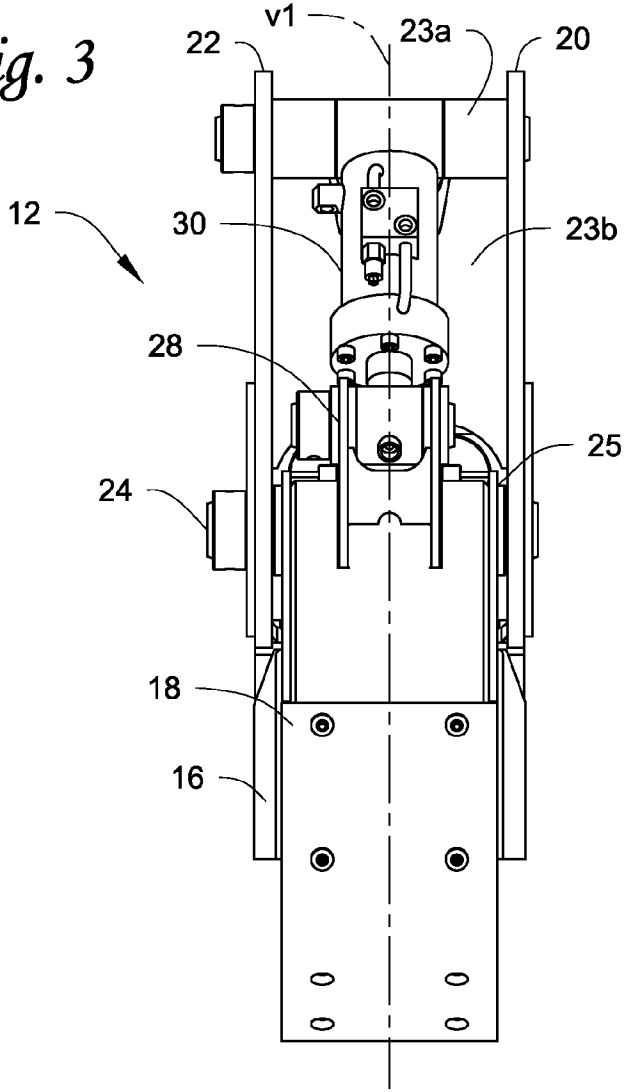
FIG. 3 is a side view of the gripping member of FIG. 2.

In one embodiment, as shown in FIGS. 2 and 3, the gripping member 12 includes a first grab arm 16 and a second grab arm 18 pivotably connected to the first grab arm 16. Alternatively, the first grab arm 16 can be pivotably connected to the second grab arm 18. When viewing the gripping member 12 from the side, as in FIG. 3, the grab arms 16, 18 are positioned so that each grab arm 16, 18 has the same vertical axis v1, i.e. the grab arms 16, 18 are not offset. In another embodiment, the grab arms 16, 18 could be on different vertical axes, thereby being offset from each other.

The gripping member 12 includes a first plate 20 and second plate 22 spaced from and parallel to each other. The first plate 20 and second plate 22 are connected to each other. The plates 20, 22 can be connected by the use of suitable fastening means 23*a*, 23*b*, as shown in FIGS. 2 and 3, sufficient to keep the plates 20, 22 spaced and form a strong support member 130. For example, the fastening means can be rods, bolts, pins, and/or spacer plates or any other method of fastening. A main beam structure opening 21 is provided in each of the plates 20, 22 to receive the main beam structure 14 of the gripping assembly 11. The main beam structure openings 21 are aligned with each other to form the opening 132. In the embodiment shown, the main beam structure openings 21 are shown as being square in shape, but it is understood that the main beam structure openings 21 can be any shape so long as the main beam structure 14 can be received and the gripping member 12 can not move rotationally on the main beam structure 14. The shown main beam structure openings 21 are closed in that they are bounded on all sides by the plate 20, 22 but it is understood that the main beam structure openings 21 can be open or slotted on one side or more sides.

The first grab arm 16 is integrally formed with the gripping member 12 and is non-pivotable. The second grab arm 18 is pivotably connected between the first plate 20 and the second plate 22. In the embodiment shown, a rod as a fastening means 24 is disposed in a tube arm pivot 25 of the second grab arm 18 and the fastening means 24 is connected to the first plate 20 and the second plate 22. Other methods of attaching the second grab arm 18 to the plates 20, 22 can be used so long as the second grab arm 18 pivots.

As shown in FIGS. 2 and 3, the second grab arm 18 has a pivot main beam structure 28 and is pivotably connected to one end of an actuator 30. The other end of the actuator 30 is pivotably connected between the first plate 20 and second plate 22 of the gripping member 12. Actuation of the actuator 30 moves the second grab arm 18 between an open or non-gripping position and a closed or gripping position.

The gripping member 12 is mountable on the main beam structure 14 by inserting the main beam structure 14 through the aligned openings 21. Once mounted on the main beam structure 14, the gripping member 12 cannot rotate relative to the main beam structure 14. The fastening pin 7 is then connected to the gripping member 12, and the fastening means 6 connected to the actuator 8 and the main beam structure 14, as illustrated in FIGS. 1A, 1B and 10. This prevents the gripping member 12 from sliding off of the main beam structure 14.

As illustrated in FIG. 4, the support member 130 and the first and second grab arms 16, 18 define an object receiving area when the first and second grab arms 16, 18 are at the gripping position in which is received an object such as a pipe. The object receiving area is disposed below the main beam structure opening 132. In addition, the object receiving area includes a center C, and the object receiving area and the main beam structure opening 132 are positioned relative to each other such that in a front view of the gripping member as in FIG. 4, a vertical line L-L extending through the center of the object receiving area also extends through a center of the main beam structure opening 132. The gripping members 9, 13 define similar object gripping areas and the relation between the gripping areas and the main beam structure openings is the same.

A horizontal plane H is located at the tip 17 of the first grab arm 16 and is perpendicular to the vertical line L-L that bisects the main beam structure opening 132. The first grab arm 16 has a concave contact surface 26 that has a radius r1 that is, preferably, approximately equal to the radius of the pipe. The radius r1 can be, for example, approximately 10 inches for use with pipe having a twenty inch outer diameter. Alternatively, the concave contact surface 26 may have a radius r1 that is slightly larger than half the diameter of the pipe. When in the gripping position, the first grab arm 16 tip 17 is configured to be on the same horizontal plane H as the centre point C of the circle created by the pipe at an approximate distance r1 from the centre point C.

The second grab arm 18 is preferably configured so that it has a concave contact surface 27 that has a radius r2 that is approximately equal to the radius of the pipe. Alternatively, the concave contact surface 27 may have a radius r2 that is slightly larger than half the diameter of the pipe. The tip 19 of the second grab arm 18 is configured to be disposed at an angle θ of approximately 40° from the horizontal plane H and at an approximate distance r2 from the centre point C. It is to be understood that the angle θ can be more or less than 40°. The first grab arm 16 and second grab arm 18 are configured so that the concave contact surfaces 26, 27 come in contact with the pipe when gripping the pipe.

As shown in FIG. 2, each grab arm 16, 18 has a profile that tapers towards a free end. The gripping member 12 is configured so that only the second grab arm 18 is movable when the gripping motion is actuated. In another embodiment, the gripping member 12 is configured so that the first grab arm 16 is movable relative to the second grab arm 18 when the gripping motion is actuated. The actuator 30 is used to actuate and move the second grab arm 18 between a gripping and non-gripping position. Load hold valves are incorporated on the actuators 30 such that the second grab arm 18 stays locked in place in the event of a hydraulic hose or pressure failure.

The grab arms 16, 18 can include resilient pads 31, 32, 33, 34, 35, 36 as shown in FIG. 2. The pads 32, 34 are preferably vulcanized rubber with a steel backing but can be any material, including rubber or plastic, that provides a positive grip while protecting the pipe. The pads 32, 34 can be somewhat resilient to aid the pipe to resist lateral and rotational movement once clamped. The pads 33, 35 are protection pads that are preferably a UMHW plastic or Nylatron®, but can be any type of plastic, rubber or other material. The pads 33, 35 allow the grab arms 16, 18 to contact adjacent pipes while protecting the contacted pipes from damage and allow the grab arms 16, 18 to slide easily along the contacted pipe. The pads 31, 36 are tip pads that can be made of the same material as the pads 32, 34 or the protection pads 33, 35. The pads 31, 32, 33, 34, 35, 36 are configured to allow for the removal and replacement of the pads 31, 32, 33, 34, 35, 36. The pads 31, 32, 33, 34, 35, 36 are preferably installed on the grab arms 16, 18 so any part of the gripping member 12 that comes in contact with the pipe, or with adjacent pipes, is covered by the pads 31, 32, 33, 34, 35, 36. The pads 31, 32, 33, 34, 35, 36 can be provided as one continuous piece or can be provided in sections.

When open, the grab arm 16, 18 tips 17, 19 extend slightly wider than the diameter of the pipe such that the gripping member 12 can be placed over the pipe. In addition, the gripping member 12 is configured to limit the amount the second grab arm 18 can move towards the first grab arm 16 when a gripping position is actuated, thus preventing damage to the pipe by crushing. This limitation can be incorporated physically or through electronic controls or software.

Figure 5:
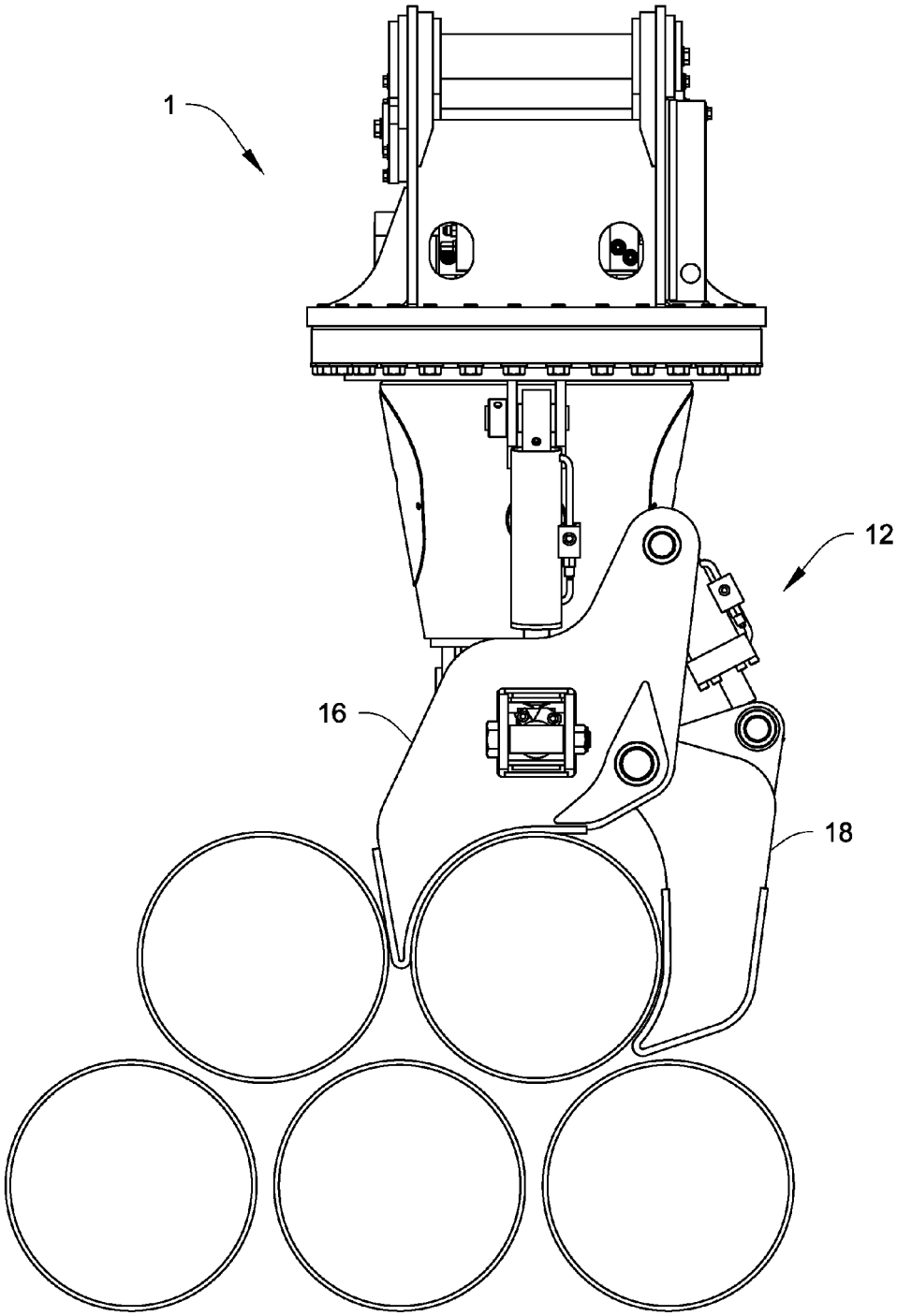
FIG. 5 is an illustration of the gripping assembly with the gripping members of FIG. 2 in use and removing a single pipe from a pipe stack.

It is preferred that the grab arms 16, 18 do not open to such an extent to permit the gripping member 12 from spanning the top of more than one pipe to prevent picking up more than one pipe. As shown in FIG. 5, as the gripping member 12 is lowered toward a pipe stack, the profile of the grab arms 16, 18 guide the grab arms 16, 18 down the curved outer surfaces between two pipes and the narrow free end of the first grab arm 16 permits the first grab arm 16 to more easily fit between adjacent pipes. Once the second grab arm 18 is past the center line of the pipe, the second grab arm 18 is actuated to a gripping position so that the pipe is securely held within the gripping member 12 and the pipe can be safely lifted. The tip 17 of the first grab arm 16 contacts the pipe at approximately the center line of the pipe. The gripping member 12 is thus able to grasp and load or offload the pipes, without disturbing adjacent pipes.

Figure 7:
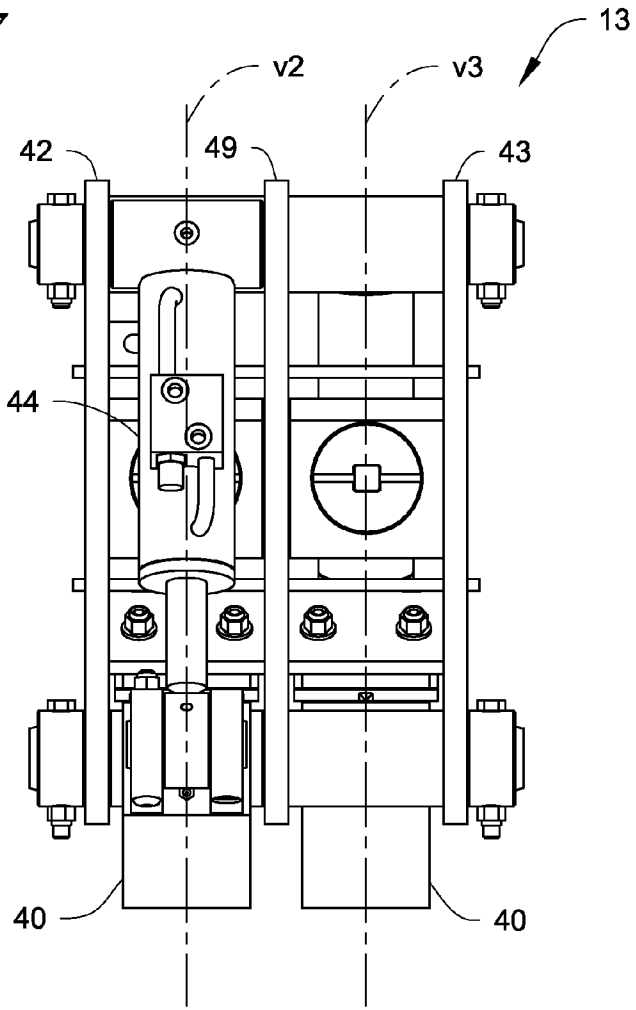
FIG. 7 is a side view of the gripping member of FIG. 6.
Figure 6:
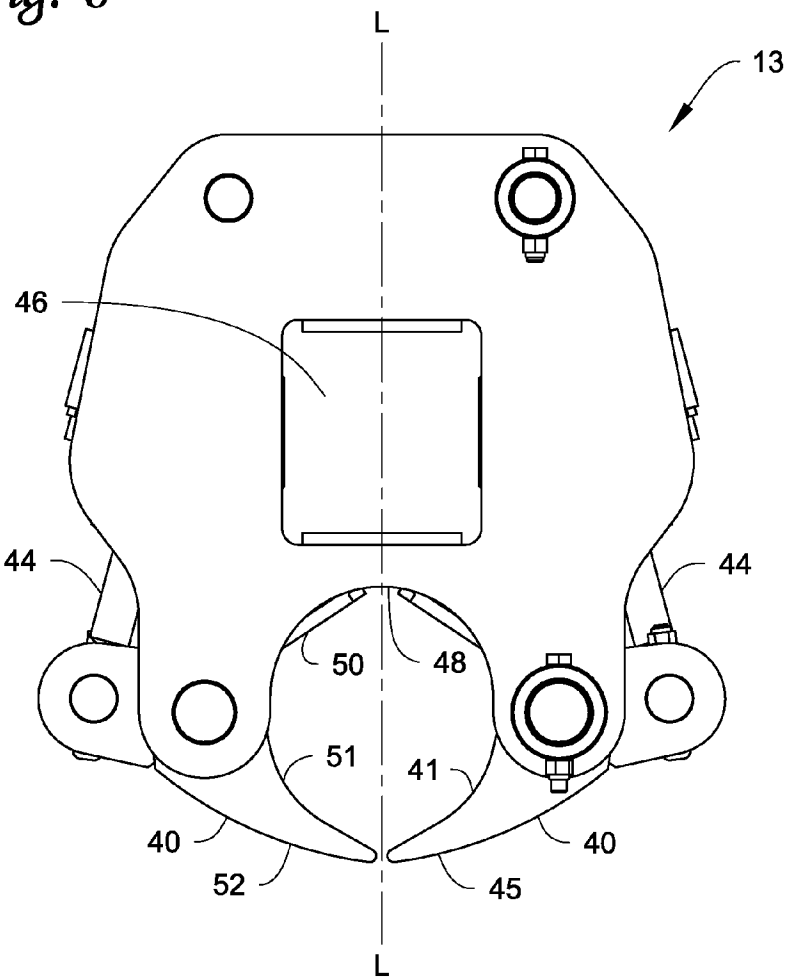
FIG. 6 is a front view of one of the gripping members shown in FIG. 1B having two crescent shaped movable grab arms.

In the embodiment shown in FIGS. 1B, 6 and 7, the gripping member 13 is provided with two grab arms 40 that are movable. The gripping member 13 includes a first plate 42 and a second plate 43 spaced apart and parallel to each other. The grab arms 40 are pivotably connected to the first and second plates 42, 43. Separate actuators 44 are connected to each grab arm 40. One end of each actuator 44 is connected to the respective grab arm 40 and the other end of the actuator 44 is connected to the plates 42, 43.

The gripping member 13 is configured to be slidably connected to the main beam structure 14 in a manner similar to the gripping member 12. As shown in FIG. 6, the gripping member 13 is provided with main beam structure openings 46 in the plates 42, 43 where the openings 46 are aligned with each other. When viewing the gripping member 13 from the side, as in FIG. 7, the grab arms 40 are positioned so that the grab arms 40 have different vertical axes v2, v3, i.e. the grab arms 40 are offset. When offset, the grab arms 40 can be configured so that the grab arms 40 bypass each other when in the gripping position. In another embodiment, the grab arms 40 have the same vertical axis and are not offset.

In the embodiment shown, the main beam structure openings 46 are shown as being square in shape, but it is understood that the main beam structure openings 46 can be any shape so long as the main beam structure 14 can be received and the gripping member 13 can be mounted on the main beam structure 14. The shown main beam structure openings 46 are closed in that they are surrounded on all sides by the plate 42, 43 but it is understood that the main beam structure openings 46 can be open or slotted on one side or more sides.

The gripping member 13 includes a third plate 49 that is disposed between and connected to the first plate 42 and the second plate 43. The third plate 49 includes a main beam structure opening that aligns with the main beam structure openings 46 of the first plate 42 and the second plate 43. One of the grab arms 40 is connected between the first plate 42 and the third plate 49 and the other grab arm 40 is connected between the second plate 43 and the third plate 49 so that the grab arms 40 are on different vertical axes v2, v3. It is to be understood that the inclusion of a third plate 49 is not necessary as long as a means is provided that allows separation of the grab arms 40. For example, spacers or washers can be inserted between the grab arms 40.

The plates 42, 43, 49 have a concave contact surface 48 that has a radius approximately equal to half the diameter of the pipe to be moved. In another embodiment, the concave contact surfaces 48 can have a radius that is slightly larger than the diameter of the pipe to be moved. In another embodiment, the contact surfaces 48 are not related to the diameter of the pipe and can have any radius or can be a straight edge.

The grab arms 40 are configured so that they open and close simultaneously. When open, the grab arms 40 preferably extend slightly more than the diameter of a pipe. Preferably, the grab arms 40 do not open to a width that would span the top of more than one pipe to prevent gripping more than one pipe. As the gripping member 13 is lowered, the profile of the grab arms 40 guide the grab arms 40 down and around the curved outer surfaces of the pipe and the narrow free end of the grab arms 40 permits the grab arms 40 to more easily fit between adjacent pipes. Once the grab arms 40 are past the center line of the pipe, the grab arms 40 are actuated so that the pipe is moved up to and against the concave contact surface 48 so that the pipe is securely held within the gripping member 13 and can be safely moved.

The grab arms 40 are configured so that the front side 41 comes in contact with the pipe when closed around the pipe. Each grab arm 40 has a profile that tapers towards a free end. The gripping member 13 is configured so that both grab arms 40 move simultaneously when the gripping motion is actuated. The actuators 44 are used to actuate and move the grab arms 40. Each grab arm 40 has its own actuator 44. Load hold valves are incorporated on the actuators such that the grab arms 40 stay locked in place in the event of a hydraulic hose or pressure failure.

The free end of the grab arm also has a back side 45. In one embodiment, as illustrated in FIG. 6, the front side 41 of each grab arm 40 is a curved gripping surface whose radius is approximately half the diameter of the pipe. The grab arm 40 free end is elongated allowing for pipe to be picked from the center of a pipe rack.

The concave contact surface 48, the front side 41 and back side 45 of the grab arms 40 can include pads 50, 51, 52. The concave contact surface 48 pads 50 are installed to create a generally V-shape allowing for a tight grip. The pads 50, 51, 52 can be provided as one continuous pad that covers the entire surface of the grab arms 40 or can be provided as non-continuous individual pieces that cover a major portion of the grab arms 40.

The pads 50, 51 are preferably vulcanized rubber with a steel backing but can be any material that provides a positive grip while protecting the pipe, including rubbers, plastics or other materials. The pads 50, 51 can be somewhat resilient to aid the pipe to resist lateral and rotational movement once clamped. Protection pads 52 are preferably a UMHW plastic or Nylatron®, but can be any type of plastic, rubber or other material. The protection pads 52 allow the grab arms 40 to contact adjacent pipes while protecting the pipes from damage and allows the grab arms 40 to slide easily along the adjacent pipe.

Grab arm 40 tip pads can be provided and made of the same material as the pads 50, 51 or the protection pads 52. The pads 50, 51, 52 are configured to allow for the removal and replacement of the pads 50, 51, 52. The pads 50, 51, 52 are preferably installed on the grab arms 40 so any part of the gripping member 13 that comes in contact with the pipe, or with adjacent pipes, is covered by the pads 50, 51, 52. The pads 50, 51, 52 can be provided as one continuous piece or can be provided in sections.

As illustrated in FIG. 6, the support member 130 and the grab arms 40 define an object receiving area when the first and second grab arms 40 are at the gripping position in which is received an object such as a pipe. The object receiving area is disposed below the main beam structure opening defined by the aligned openings 46. In addition, the object receiving area includes a center, and the object receiving area and the main beam structure opening are positioned relative to each other such that in a front view of the gripping member as in FIG. 6, a vertical line L-L extending through the center of the object receiving area also extends through a center of the main beam structure opening.

Figure 9:
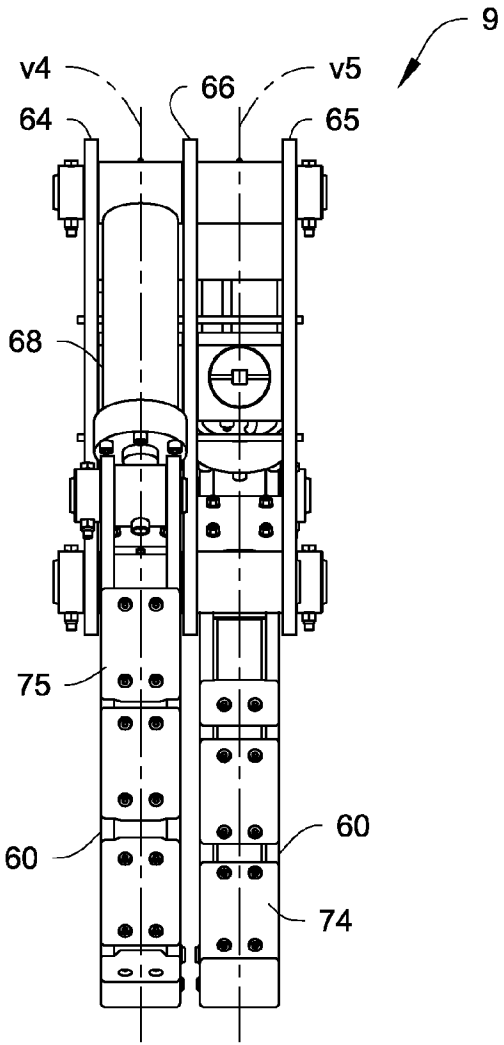
FIG. 9 is a side view of the gripping member of FIG. 8.
Figure 8:
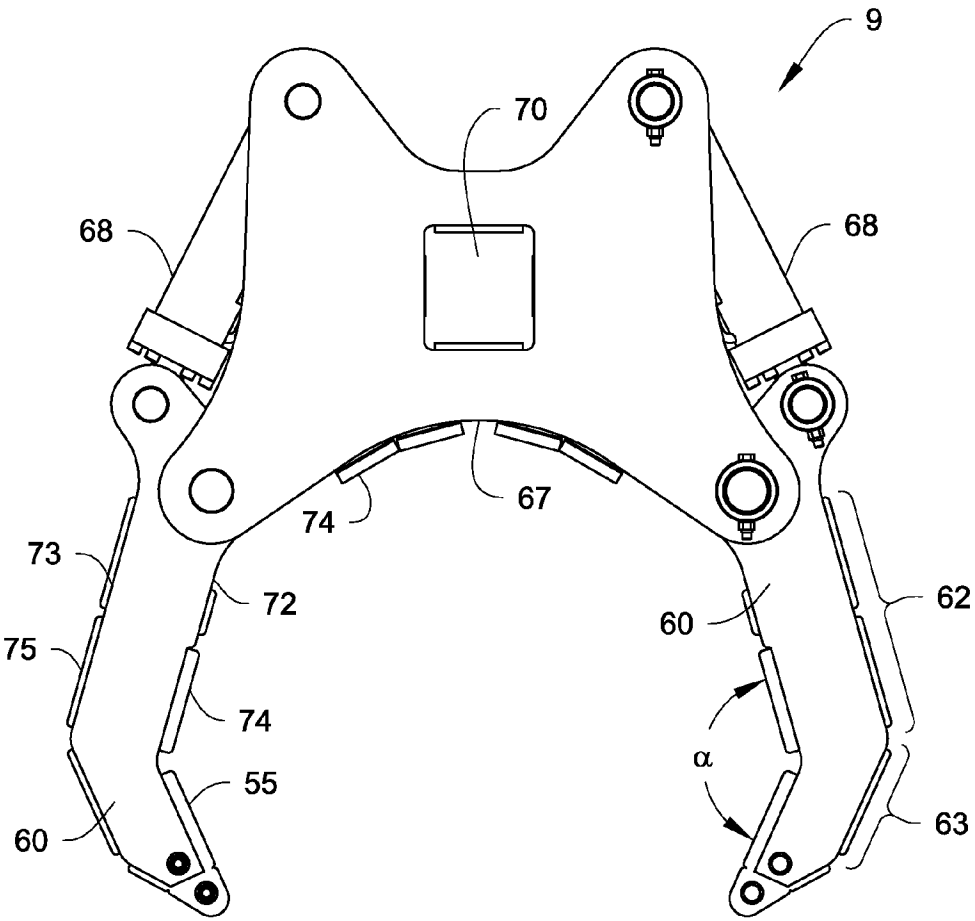
FIG. 8 is a front view of one of the gripping members from FIG. 1A having two modified L-shaped movable grab arms.

Details of the gripping member 9 are shown in FIGS. 8 and 9. The gripping member 9 includes two movable grab arms 60. Each grab arm 60 contains an elongated section 62 and a shorter section 63, that are integrally connected, where an angle $\alpha$ is created where the sections 62, 63 meet. Due to the configuration of the grab arms 60, this embodiment creates six points of contact on the pipe. The elongation and angle $\alpha$ of the grab arms 60 allows for pipe to be picked from a pipe stack without unduly moving the adjacent pipes.

In the embodiment shown, the gripping member 9 includes a first plate 64 and a second plate 65 spaced apart and parallel to each other. The grab arms 60 are pivotably connected to the first and second plates 64, 65. Separate actuators 68 are connected to each grab arm 60. One end of the actuator 68 is connected to the grab arm 60 and the other end of the actuator 68 is connected to the plates 64, 65.

The gripping member 9 is configured to be slidably connected to the main beam structure 14 similar to the gripping members 12, 13. As shown in FIG. 8, the gripping member 9 is provided with aligned main beam structure openings 70 in the plates 64, 65. In the embodiment shown, the main beam structure openings 70 are shown as being square in shape, but it is understood that the main beam structure openings 70 can be any shape.

When viewing the gripping member 9 from the side, as in FIG. 9, the grab arms 60 are positioned so that the grab arms 60 have different vertical axes v4, v5, i.e. the grab arms 60 are offset. The grab arms 60 can be configured so that when offset they bypass each other in the gripping position. In another embodiment, the grab arms 60 have the same vertical axis and are not offset.

A third plate 66 is disposed between and connected to the first plate 64 and the second plate 65. The third plate 66 also includes a main beam structure opening that aligns with the main beam structure openings 70 of the first plate 64 and the second plate 65. One of the grab arms 60 is connected between the first plate 64 and the third plate 66 and the other grab arm 60 is connected between the second plate 65 and the third plate 66 so that the grab arms 60 are on different vertical axes v4, v5. It is to be understood that the inclusion of a third plate 66 is not necessary as long as a means is provided that allows separation of the grab arms 60. For example, spacers or washers can be inserted between the grab arms 60.

In one embodiment, the plates 64, 65, 66 have a concave contact surface 67 that has a radius approximately equal to half the diameter of the pipe to be moved. In another embodiment, the concave contact surface 67 can have a radius that is slightly larger than the diameter of the pipe to be moved. In another embodiment, the contact surface 67 is not related to the diameter of the pipe and can have any radius or can be a straight edge.

The grab arms 60 are configured so that they open and close simultaneously. When open, the grab arms 60 preferably extend slightly more than the diameter of a pipe and preferably do not extend wide enough to grip more than one pipe. As the gripping member 9 is lowered, the profile of the grab arms 60 guide the grab arms 60 down and around the curved outer surfaces of the pipe and the narrow free end of the grab arms 60 permits the grab arms 60 to more easily fit between adjacent pipes. Once the grab arms 60 are past the center line of the pipe, the grab arms 60 are actuated so that the pipe is moved up to and against the concave contact surface 67 so that the pipe is securely held within the gripping member 9 and can be safely moved.

The grab arms 60 are configured so that the contact surfaces 55 come in contact with the pipe when closed around the pipe. In the embodiment shown, there are six points of contact. Each grab arm 60 has a profile that tapers towards a free end. Load hold valves are incorporated on the actuators 68 such that the grab arms 60 stay locked in place in the event of a hydraulic hose or pressure failure.

The free end of the grab arm 60 has a front side 72 and a back side 73. The grab arm 60 free end is elongated allowing for pipe to be picked from the center of a pipe pile.

The concave contact surface 67, the front side 72 and back side 73 of the grab arms 60 can include pads 74, 75. The pads 74 on the concave contact surface 67 are installed in a generally V-shape allowing for a tight grip. The pads 74, 75 can be provided as one continuous pad or can be provided as non-continuous individual pieces.

The pads 74 are preferably vulcanized rubber with a steel backing but can be any material that provides a positive grip while protecting the pipe, including rubbers, plastics or other materials. The pads 74 can be somewhat resilient to aid the pipe to resist lateral and rotational movement once clamped. Protection pads 75 are preferably a UMHW plastic or Nylatron®, but can be any type of plastic, rubber or other material. The protection pads 75 allow the grab arms 60 to contact adjacent pipes while protecting the pipes from damage and allows the grab arms 60 to slide easily along the pipe.

Grab arm 60 tip pads can be provided and made of the same material as the pads 74 or the protection pads 75. The pads 74, 75 are configured to allow for the removal and replacement of the pads 74, 75. The pads 74, 75 are preferably installed on the grab arms 60 so any part of the gripping member 9 that comes in contact with the pipe, or with adjacent pipes, is covered by the pads 74, 75. The pads 74, 75 can be provided as one continuous piece or can be provided in sections.

It is understood that the shape or configuration of the grab arms is not limited to the embodiments as described above and can be any shape or configuration that allows for the encompassing and gripping of pipe.

Due to the positive control provided by the tilt actuators 118 connected to the main beam structure 14 and the use of two gripping members 9, 12, 13, pipe is able to be gripped by the grapple attachment 1 and controlled and placed without the use of additional manpower and without the need for precise centering of the gripping members 9, 12, 13 on the pipe. It is preferred that two gripping members 9, 12, 13 be provided for use on the gripping assembly 11 but any number of gripping members 9, 12, 13 may be provided.

The examples and embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A gripping member useable with a gripping assembly of a grapple attachment, comprising:

a support member, the support member includes a main beam structure opening extending laterally therethrough that is configured to receive a main beam structure of the gripping assembly, the main beam structure opening is a closed opening where in a front view of the support member the closed opening is bounded on all sides by the support member;

a first grab arm and a second grab arm connected to the support member, each of the first grab arm and the second grab arm taper toward a free end, at least one of the first and second grab arms is pivotally connected to the support member, the first and second grab arms have a gripping position and a non-gripping position;

a first actuator having one end connected to the support member and a second end connected to the one pivotally connected grab arm;

wherein the support member and the first and second grab arms define an object receiving area when the first and second grab arms are at the gripping position, the object receiving area is disposed below the main beam structure opening.

2. The gripping member of claim 1, wherein the support member comprises a first plate and a second plate, the first plate and the second plate are spaced from and parallel to each other and are connected to each other, each of the first plate and the second plate includes a closed opening, and the closed openings in the first and second plates are aligned to define the main beam structure opening.

3. The gripping member of claim 1, wherein the first actuator is a hydraulic actuator, a pneumatic actuator, or a mechanical actuator.

4. The gripping member of claim 1, wherein the first grab arm is integrally connected to the support member, and the second grab arm is pivotally connected to the support member, and the second end of the first actuator is connected to the second grab arm.

5. The gripping member of claim 1, wherein the first grab arm and the second grab arm are on the same vertical plane.

6. The gripping member of claim 1, wherein a tip of the second grab arm is below a horizontal plane extended from a tip of the first grab arm, and the first grab arm is fixed and the second grab arm is movable.

7. The gripping member of claim 1, wherein the first grab arm and the second grab arm each have front and back surfaces, the front surfaces of the first and second grab arms face each other, and the back surfaces of the first and second grab arms have a protective pad.

8. The gripping member of claim 1, wherein the first grab arm is pivotally connected to the support member, and the second end of the first actuator is connected to the first grab arm, and the second grab arm is pivotally connected to the support member, and further comprising a second actuator having a first end connected to the support member and a second end connected to the second grab arm, wherein the first grab arm and the second grab arm are pivotally movable.

9. The gripping member of claim 2, further comprising a third plate disposed between and connected the first plate and the second plate, the third plate is spaced from and parallel to each of the first and second plates, the third plate includes a closed opening that is aligned with the closed openings in the first and second plates and which also defines the main beam structure opening;

the first grab arm is disposed between the first plate and the third plate, and the second grab arm is disposed between the second plate and the third plate, wherein the first and second grab arms are on different vertical planes.

10. The gripping member of claim 1, wherein the object receiving area includes a center, and the object receiving area and the main beam structure opening are positioned relative to each other such that in a front view of the gripping member, a vertical line extending through the center of the object receiving area extends through a center of the main beam structure opening.

11. The gripping member of claim 1, wherein the support member has a concave contact surface that defines a portion of the object receiving area.

12. The gripping member of claim 1, wherein a tip of the second grab arm is lower than a horizontal plane extended from a tip of the first grab arm; and the first grab arm is fixed and the second grab arm is movable.

13. The gripping member of claim 1, wherein a tip of the second grab arm is on the same horizontal plane as that of a tip of the first grab arm.

14. The gripping member of claim 1, wherein the first and second grab arms include surfaces that face the object receiving area when at the gripping position, and further comprising resilient pads connected to the surfaces.

15. The gripping member of claim 14, further comprising resilient pads on surfaces of the first and second grab arms opposite the surfaces that face the object receiving area.

16. A grapple attachment, comprising:

a bracket attachment configured to attach to a piece of construction equipment;

a lower head assembly connected to the bracket attachment and configured to be rotatable about a swivel axis;

a gripping assembly pivotally connected to the lower head assembly for pivoting movement about a pivot axis that is substantially perpendicular to the swivel axis;

the gripping assembly includes a main beam structure that extends along a longitudinal axis that is substantially perpendicular to the swivel axis and the pivot axis, and a plurality of gripping members mounted on the main beam structure, each of the plurality of gripping members are actuatable between a non-gripping position and a gripping position, and each gripping member is movable on the main beam structure so as to be adjustable in position on the main beam structure relative to the swivel axis and the pivot axis in a direction parallel to the longitudinal axis.

17. The grapple attachment of claim 16, wherein the gripping members are adjustable together or individually.

18. The grapple attachment of claim 16, further comprising tilt actuators, each tilt actuator having a first end connected to the lower head assembly and a second end connected to the main beam structure.

19. A gripping member useable with a gripping assembly of a grapple attachment, comprising:

a support member, the support member includes a main beam structure opening extending laterally therethrough that is configured to receive a main beam structure of the gripping assembly, the main beam structure opening is a closed opening where in a front view of the support member the closed opening is bounded on all sides by the support member;

a first grab arm and a second grab arm connected to the support member, each of the first grab arm and the second grab arm taper toward a free end, at least one of the first and second grab arms is movably connected to the support member, the first and second grab arms have a gripping position and a non-gripping position;

a first actuator having one end connected to the support member and a second end connected to the movably connected grab arm;

wherein the support member and the first and second grab arms define an object receiving area when the first and second grab arms are at the gripping position, the object receiving area is disposed below the main beam structure opening.

* * * * *